United States Patent [19]

Shapcott

[11] Patent Number: 4,879,025

[45] Date of Patent: Nov. 7, 1989

[54] APPARATUS FOR SORTING PARTS

[75] Inventor: Michael Shapcott, Tamaqua, Pa.

[73] Assignee: Zapata Technologies, Inc., Hazelton, Pa.

[21] Appl. No.: 146,517

[22] Filed: Jan. 21, 1988

[51] Int. Cl.[4] ..... B07C 5/00

[52] U.S. Cl. ..... 209/559; 209/564; 209/606; 209/928

[58] Field of Search ..... 209/560, 561, 562, 563, 209/564, 565, 606, 928, 934; 198/372, 441

[56] References Cited

U.S. PATENT DOCUMENTS

| | | | |
|---|---|---|---|
| 2,108,257 | 2/1938 | Earling . | |
| 3,382,974 | 5/1968 | Mayeux . | |
| 3,411,009 | 11/1968 | Ford et al. | 209/565 X |
| 3,417,241 | 12/1968 | Davis | 209/524 X |
| 3,432,033 | 3/1969 | Everett . | |
| 3,651,937 | 3/1972 | Kronseder | 209/526 X |
| 3,887,284 | 6/1975 | Gender et al. | 209/526 X |
| 3,920,541 | 11/1975 | VanderBerg . | |
| 4,019,622 | 4/1977 | Messervey . | |
| 4,105,122 | 8/1978 | Flood et al. | 209/564 X |
| 4,476,981 | 10/1984 | Yoshida . | |
| 4,596,102 | 6/1986 | Pfleger, Sr. | 209/606 X |

*Primary Examiner*—Joseph J. Rolla
*Assistant Examiner*—Mona C. Beegle
*Attorney, Agent, or Firm*—Pennie & Edmonds

[57] ABSTRACT

A sorting device suitable for sorting defective parts from a stream of parts is disclosed. The parts may be non-magnetic. A sorting disc having a number of recesses disposed around its periphery receives the parts to be sorted. A reject disc having a number of reject devices on its tangent to the sorting disc and rotates such that the peripheral speed of the reject devices at the point of tangency is the same as the speed of the recesses in the sorting disc. When a defective part is detected, the appropriate one of the reject devices is activated, withdrawing the defective part from the corresponding recess in the sorting disc.

10 Claims, 2 Drawing Sheets

APPARATUS FOR SORTING PARTS

FIELD OF THE INVENTION

This invention relates to a device for sorting parts. More particularly, this invention relates to an apparatus for sorting individual non-magnetic parts, such as aluminum or plastic bottle caps, at high speed, from a stream of such parts in response to a signal from an inspection device that one of the parts is defective.

BACKGROUND OF THE INVENTION

The assignee of the present application has been making and selling apparatus for sorting magnetic parts such as steel bottle caps for more than a year prior to the filing of this application. That apparatus comprises a sorting disc having a number of recesses for receiving such caps disposed about its periphery. A video inspection device is aligned with the sorting disc such that caps disposed in the recesses are momentarily aligned with the inspection device as the sorting disc is rotated. When the inspection device determines that a particular cap is defective, it passes a "reject" signal to a rotating reject disc. The reject disc comprises a number of individually-actuable electromagnets disposed about its periphery, and is located such that the linear speed of the electromagnets is equal to that of the recesses in the periphery of the sorting disc at a point at which the two discs are tangent. Accordingly, when a reject signal is supplied to one of the magnets on the reject disc, the corresponding cap is magnetically attracted thereto, so that as the discs continue to rotate the cap is withdrawn from its recess in the sorting disc, and is placed in a reject bin. Meanwhile, parts which are found suitable after inspection are removed from the sorting disc by mechanical fingers overlapping the disc and are supplied to a good parts bin, or to another processing operation. These parts are being processed at speeds up to and exceeding 2500 parts per minute.

While the device described has been found suitable for its intended purpose, and is capable of effective sorting of parts at very high rates, it is not suitable for sorting non-magnetic parts such as plastic or aluminum bottle caps. It would be desirable to provide such a sorting device which is also usable with plastic or aluminum parts to be sorted.

SUMMARY OF THE INVENTION

According to the present invention, there is provided a parts sorting apparatus which is useful with non-magnetic parts such as plastic or aluminum bottle caps. According to the invention, a reject disc tangent to a sorting disc has a number of solenoids disposed about its periphery. When a reject signal is received, the corresponding solenoid is actuated and removes the part from the corresponding recess in the sorting disc. For example, the solenoid may urge the part upwardly against a friction disc rotating with the reject disc. The solenoid may be de-energized some period of rotation later to allow the part to be discharged into a reject part bin.

BRIEF DESCRIPTION OF THE DRAWINGS

The invention will be better understood if reference is made to the accompanying drawings, in which.

DESCRIPTION OF THE PREFERRED EMBODIMENTS

Figure 1:
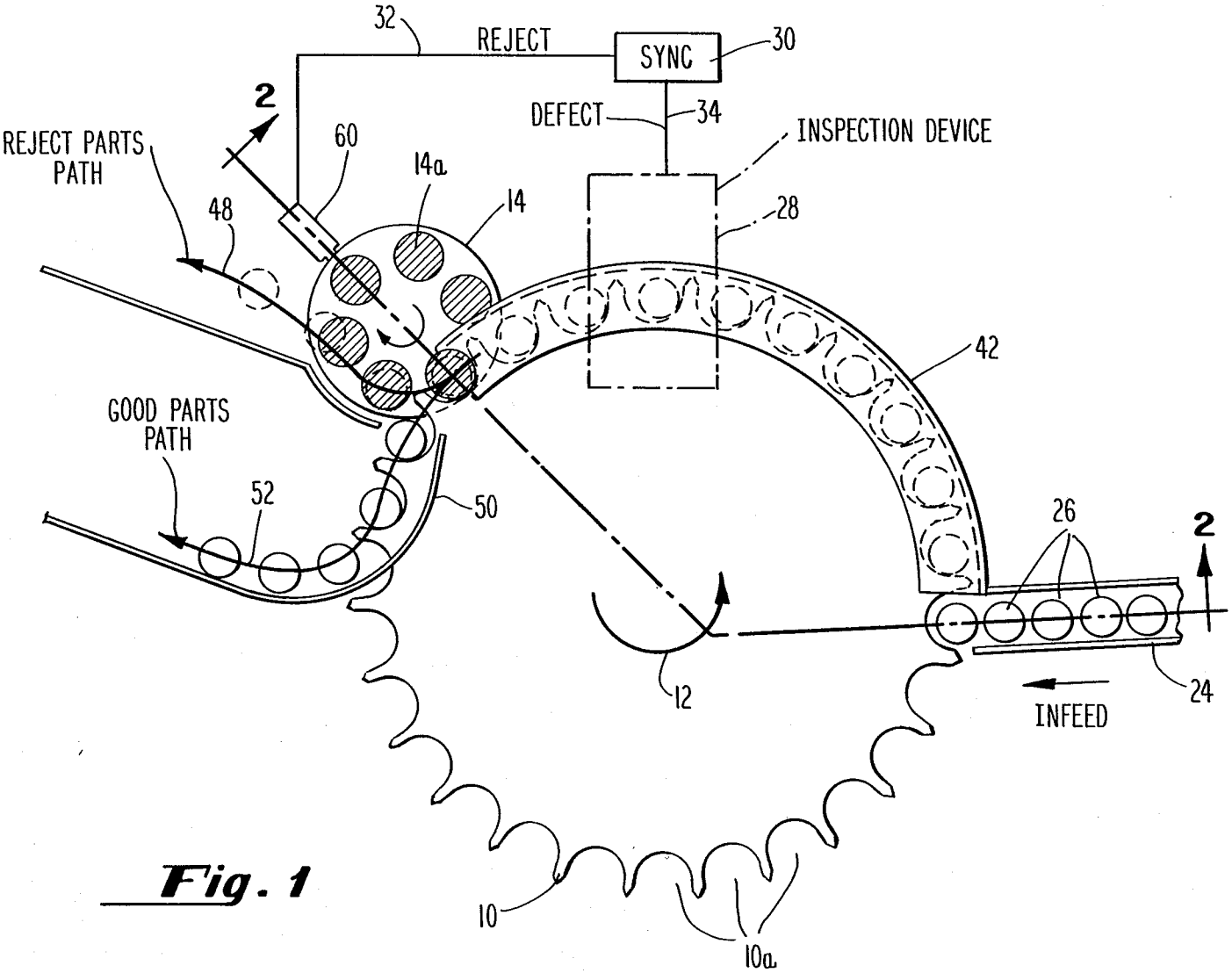
FIG. 1 represents a plan view of the parts sorting apparatus according to the invention.

The invention will now be described with reference simultaneously to FIGS. 1 and 2 in which identical components are numbered identically. The parts sorting apparatus of the invention comprises a sorting disc 10 which is rotated counter-clockwise in the embodiment shown, as indicated by the arrow 12, and a reject disc 14 which is tangent to the sorting disc 10 and is rotated in the opposite direction as also indicated. As shown in FIG. 2 the sorting disc 10 may be mounted for rotation on a shaft 16 driven by a motor 18. A gear 20 may also be mounted on the shaft 16 to drive a corresponding gear 22 on a second shaft 24 on which the reject disc 14 is mounted. Accordingly, the two discs 10 and 14 are rotated in synchronization.

Figure 2:
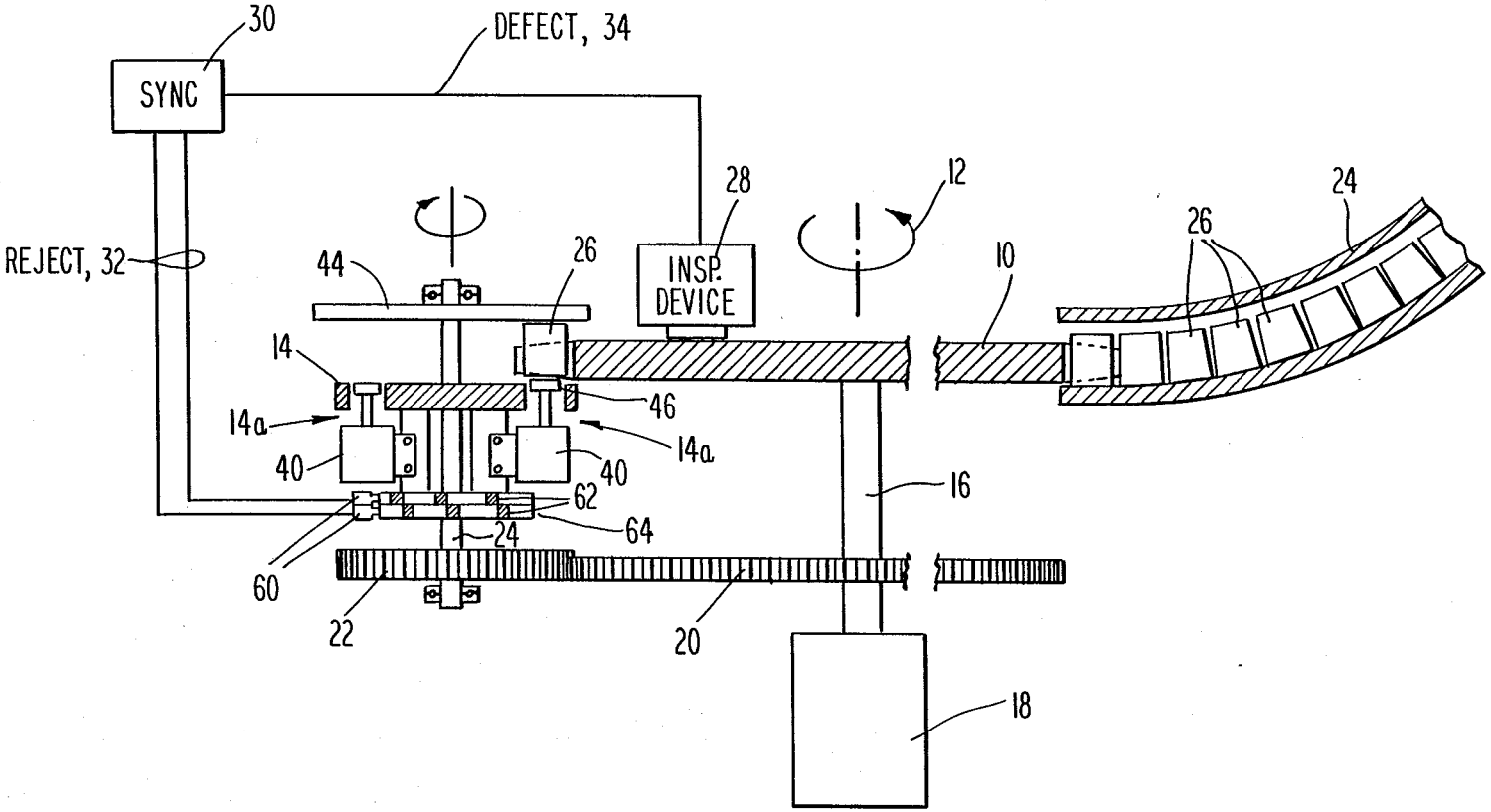
FIG. 2 represents an elevational view of the apparatus of FIG. 1.

As shown in FIG. 1, a number of recesses **10*a* are formed around the periphery of the sorting disc 10. Recesses 10*a* receive parts 26 such as plastic or aluminum bottle caps to be sorted. The parts 26 are received from an in-feed conveyer assembly 24, and are regularly spaced from one another by disposition in the recesses 10*a*. The sorting disc 10 is rotated continually such that a constant stream of parts 26 to be inspected are presented to an inspection device 28**.

In a preferred embodiment the inspection device may be the model "ZA-vid" sold by the assignee of the present application. This device essentially comprises a video inspection device manufactured by Video Tek Inc. of Parsippany, N.J. However, the detailed function of the inspection device 28 is not germane here; any inspection device capable of measuring some parameter of a particular part 26 or otherwise deriving a signal concerning whether the part is suitable for use is satisfactory.

When the inspection device 28 determines that a particular part 26 is defective, it passes a "defect" signal to a synchronization device 30, which at the appropriate time passes a "reject" signal indicated at 32 to the reject disc 14 via brushes 60, which are described subsequently. The synchronization device 30 insures that an appropriate one of a number of identical reject mechanisms **14*a* carried by the reject disc is activated at the appropriate instant, so as to remove the defective part 26 from the corresponding recess 10*a* in the periphery of sorting disc 10**.

As indicated by the hatched circles shown on reject disc 14 in FIG. 1, in this embodiment the sorting device according to the invention may comprise six identical reject mechanisms **14*a* for removing defective parts 26 from an incoming stream of parts to be inspected. As shown in FIG. 2, each reject mechanism 14*a* may comprise a solenoid 40 for actuating a piston 46 to urge the defective part 26 upwardly into frictional engagement with a friction disc 44. As can be seen, the axial spacing between friction disc 44 and the reject disc 14 is sufficient to admit the parts 26 as well as the periphery of the sorting disk 10. Friction disc 44 is coaxial and rotates with reject disc 14. When the piston 46 thus engages the part 26 with the friction disc 44, continued rotation of the reject disc 14 and friction disc 44 removes the part 26 from the corresponding recess 10*a* in the sorting disc 10. Thereafter the solenoid 40 may be de-energized and the part 26 discharged by centripetal force into a reject parts bin, as indicated by the arrow 48 in FIG. 1. If the part is not thus removed from recess 10***a* in the sorting disc 10 by the reject disc 14, fingers 50 on either side of the sorting disc 10 remove the part 26 from the recess and cause it to travel along a good parts path indicated generally at 52.

During travel of the parts 26 from in-feed 24 past the inspection device 28 and onward to the reject disc 14, they are confined within recesses 10*a* by a generally U-shaped channel member 42 which encloses the periphery of sorting disc 10.

The reject signal 32 is passed to the solenoids by a pair of brushes 60 which make electrical contact with contact elements 62 carried by one or more timing discs 64 which are coaxial and rotate with the sorting disc 14. The electrical contact elements 62 are connected to the solenoids 40, such that when the reject signal 32 is present it is communicated to the appropriate solenoid 40 to energize it, urging the part 26 upwardly (as shown on the right side of reject disc 14 in FIG. 2) and thus removing it from the corresponding recess 10*a* in the disc 10.

It will be appreciated by those of skill in the art that the synchronization between the detection of a defective part by inspection device 28 and the actuation of the solenoid 40 is critical if the appropriate part is to be removed from the stream at the appropriate time. For this reason the synchronization device 30 is provided as shown schematically at 30. Of course, a wide variety of expedients can be employed to provide the necessary synchronization. The actual time lag required between passage of the part 26 beneath the inspection device 28 and the actuation of the solenoid 40 will depend on a wide variety of factors such as the response time of the inspection device, and the response time of the solenoid 40 to the reject signal, as well as a wide variety of other factors. Additionally, of course, the rotational speeds of the various discs involved will need to be considered. Accordingly, the disclosure of synchronization device 30 is intended to include all suitable adjustment devices as may be needed, which may comprise solid state timers, means for adjusting the physical positions of the various devices with respect to one another or other devices which may be employed by those of skill in the art to insure proper operation of the apparatus of the invention.

A wide range of variation in the device described is within the scope of the invention. For example, while a circular sorting disc 10 having recesses 10*a* disposed on its circular periphery has been shown, any device which is capable of separating the parts 26 from one another and spacing them apart along a portion of their path, such that the inspection device can develop a signal which is unique with respect to a single part to be removed, is suitable. Similarly, and as indicated above, a number of different types of part removal devices which do not rely on magnetic attraction of the part but which are rotatable with the reject disc 14 are considered to be within the scope of the invention.

It should also be appreciated that the brush/contact element structure used to transmit the reject signal from the inspection device 28 via the synchronization unit 30 to a magnetic reject disc described generally above was employed in the device sold commercially by the assignee of the present invention for more than a year prior to the filing of the present application which was described above.

Therefore, while a preferred embodiment of the invention has been described in detail, this should not be considered a limitation on the invention but merely as exemplary thereof; the invention is to be limited only by the following claims.

I claim:

1. Apparatus for inspecting a stream of parts and for removing defective parts from the stream of parts, comprising:

means for controlling the spacing of said parts along a portion of said stream, said spacing means comprising a moving member having a series of regularly spaced recesses along its periphery for receiving parts from said stream at a supply station, and for advancing said parts to and discharging them at a discharging station;

inspection means at a predetermined location along the portion of the stream along which the spacing of the parts is controlled by said spacing means, for providing a rejection signal with respect to a defective part; and rejection means responsive to said rejection signal, comprising:

a first rotating disc carrying a plurality of individually-actuable means for removing parts spaced equally about the axis of rotation of said first rotating disc, each means for removing parts being individually actuable responsive to said rejection signal for removing parts from said recesses in the periphery of said spacing means, the disc being located and rotated with respect to said spacing means such that the linear speed and spacing of said means for removing parts are substantially equal to the linear speed and spacing of first rotating disc;

a friction disc mounted co-axially and rotating with said first rotating disc, said friction disc being spaced from said first rotating disc by a distance at least equal to one of the dimensions of said parts and greater than the thickness of the periphery of the spacing means in which said recesses are formed, so that said parts in their corresponding recesses are disposed between said friction disc and said first rotating disc, and wherein said means for removing parts when actuated each urge the corresponding part against the friction disc, whereby the subsequent rotation of the first and friction discs withdraws the part from its recess; and synchronization means for communicating said rejection signals from said inspection means to said individually actuable means for removing parts.

2. The apparatus of claim 1 wherein said synchronization means for communicating said rejection signals to said solenoids comprises at least one contact disc comprising a number of contact elements equal to the number of said individually actuable solenoids and rotating with said first rotating disc, said contact elements being in predetermined radial relationship with corresponding ones of said solenoids, and brush means adapted to transmit said rejection signals to said contact elements to activate the solenoids.

3. The apparatus of claim 1 wherein said spacing means comprises a sorting disc rotatable about an axis and having said recesses extending radially inwardly from its circular periphery.

4. The apparatus of claim 3 wherein the axes of said sorting disc and of said first rotating and contact discs are parallel.

5. The apparatus of claim 1 wherein said inspection means comprises means for generating a video signal corresponding to an image of said part and for analyzing the same.

6. The apparatus of claim 1, wherein said parts are closures for closing containers.

7. The apparatus of claim 6, wherein said closures are non-metallic.

8. The apparatus of claim 6, wherein said closures are aluminum.

9. The apparatus of claim 1, in combination with means for supplying said stream of parts to said spacing means, and with means for receiving a stream of satisfactory parts from the spacing means and means for receiving the defective parts from the rejection means.

10. The apparatus of claim 1, wherein said individually actuable means for removing parts each comprise a solenoid adapted to urge said parts against said friction disc when actuated.

* * * * *